US007017357B2

(12) United States Patent
Brasz

(10) Patent No.: US 7,017,357 B2
(45) Date of Patent: Mar. 28, 2006

(54) EMERGENCY POWER GENERATION SYSTEM

(75) Inventor: Joost J. Brasz, Fayetteville, NY (US)

(73) Assignee: Carrier Corporation, Farmington, CT (US)

( * ) Notice: Subject to any disclaimer, the term of this patent is extended or adjusted under 35 U.S.C. 154(b) by 223 days.

(21) Appl. No.: 10/716,301

(22) Filed: Nov. 18, 2003

(65) Prior Publication Data

US 2005/0103465 A1 May 19, 2005

(51) Int. Cl.
*F25B 1/00* (2006.01)

(52) U.S. Cl. ..... 62/115; 62/116; 62/324.1

(58) Field of Classification Search ..... 62/115, 62/116, 186, 228.1, 228.3, 230, 324.1, 402, 62/324.6, 513, DIG. 2; 165/61, 63; 60/618, 60/651, 671
See application file for complete search history.

(56) References Cited

U.S. PATENT DOCUMENTS

| | | | | |
|---|---|---|---|---|
| 4,386,499 | A | 6/1983 | Raviv et al. | |
| 4,590,384 | A | 5/1986 | Bronicki | |
| 4,617,808 | A | 10/1986 | Edwards | |
| 4,760,705 | A | 8/1988 | Yogev et al. | |
| 4,901,531 | A | 2/1990 | Kubo et al. | |
| 5,038,567 | A | 8/1991 | Mortiz | |
| 5,119,635 | A | 6/1992 | Harel | |
| 5,339,632 | A | 8/1994 | McCrabb et al. | |
| 5,598,706 | A | 2/1997 | Bronicki et al. | |
| 5,632,143 | A | 5/1997 | Fisher et al. | |
| 5,640,842 | A | 6/1997 | Bronicki | |
| 5,664,419 | A | 9/1997 | Kaplan | |
| 5,761,921 | A | 6/1998 | Hori et al. | |
| 5,809,782 | A | 9/1998 | Bronicki et al. | |
| 5,860,279 | A | 1/1999 | Bronicki et al. | |
| 6,009,711 | A | 1/2000 | Kreiger et al. | |
| 6,101,813 | A | 8/2000 | Sami et al. | |
| 6,497,090 | B1 | 12/2002 | Bronicki et al. | |
| 6,526,754 | B1 * | 3/2003 | Bronicki | 60/671 |
| 6,539,718 | B1 | 4/2003 | Bronicki et al. | |
| 6,539,720 | B1 | 4/2003 | Rouse et al. | |
| 6,539,723 | B1 | 4/2003 | Bronicki et al. | |
| 6,571,548 | B1 | 6/2003 | Bronicki et al. | |
| 6,694,750 | B1 * | 2/2004 | Lifson et al. | 62/113 |
| 6,782,703 | B1 * | 8/2004 | Dovali-Solis | 60/785 |
| 6,880,344 | B1 * | 4/2005 | Radcliff et al. | 60/772 |
| 6,883,325 | B1 * | 4/2005 | Chomiak | 60/618 |
| 6,892,522 | B1 * | 5/2005 | Brasz et al. | 60/39.181 |
| 6,895,740 | B1 * | 5/2005 | Erickson | 60/39.182 |
| 6,910,333 | B1 * | 6/2005 | Minemi et al. | 60/618 |
| 6,912,853 | B1 * | 7/2005 | Amir | 60/641.5 |
| 2002/0148225 | A1 | 10/2002 | Lewis | |
| 2003/0029169 | A1 | 2/2003 | Hanna et al. | |

(Continued)

FOREIGN PATENT DOCUMENTS

| | | |
|---|---|---|
| DE | 19630559 | 1/1998 |

(Continued)

*Primary Examiner*—Mohammad M. Ali
(74) *Attorney, Agent, or Firm*—Wall Marjama & Bilinski LLP

(57) ABSTRACT

In a comfort system having a combination furnace and air conditioner, the two are operated simultaneously at periods of time in which emergency power is desired, with the air conditioning system being temporarily converted to cause the flow of refrigerant to pass from the evaporator to a high pressure side of said compressor rather than to the low pressure side thereof to thereby drive the compressor in reverse such that it operates as a turbine. The turbine then drives its motor in reverse to generate power to be supplied to the various components of the systems and to other appliances during emergency mode operation.

15 Claims, 5 Drawing Sheets

U.S. PATENT DOCUMENTS

| | | | | |
|---|---|---|---|---|
| 2003/0089110 | A1 | 5/2003 | Niikura et al. | |
| 2003/0167769 | A1 | 9/2003 | Bharathan et al. | |
| 2004/0088982 | A1* | 5/2004 | Brasz et al. | 60/651 |
| 2004/0088985 | A1* | 5/2004 | Brasz et al. | 60/670 |
| 2004/0088986 | A1* | 5/2004 | Brasz et al. | 60/671 |
| 2004/0088992 | A1* | 5/2004 | Brasz et al. | 60/772 |

FOREIGN PATENT DOCUMENTS

| | | | |
|---|---|---|---|
| DE | 19650183 | A1 * | 6/1998 |
| DE | 19907512 | | 8/2000 |
| DE | 10029732 | | 1/2002 |
| EP | 1243758 | | 9/2002 |
| JP | 52046244 | | 4/1977 |
| JP | 54045419 | | 4/1979 |
| JP | 54060634 | | 5/1979 |
| JP | 55091711 | | 7/1980 |
| JP | 58088409 | | 5/1983 |
| JP | 58122308 | | 7/1983 |
| JP | 59043928 | | 3/1984 |
| JP | 59054712 | | 3/1984 |
| JP | 59063310 | | 4/1984 |
| JP | 59138707 | | 8/1984 |
| JP | 59158303 | | 9/1984 |
| JP | 60158561 | | 8/1985 |
| JP | 06088523 | | 3/1994 |
| JP | 9-170405 | A * | 6/1997 |
| JP | 2002266655 | | 9/2002 |
| JP | 2002285805 | | 10/2002 |
| JP | 2002285907 | | 10/2002 |
| JP | 2003-90641 | A * | 3/2003 |
| JP | 2003161101 | | 6/2003 |
| JP | 2003161114 | | 6/2003 |
| WO | 98/06791 | | 2/1998 |
| WO | 02/099279 | | 12/2002 |
| WO | 03/078800 | | 9/2003 |

* cited by examiner

EMERGENCY POWER GENERATION SYSTEM

BACKGROUND OF THE INVENTION

This invention relates generally to heating and air conditioning systems and, more particularly, to a method and apparatus for operating such systems in an emergency power generating mode.

Power outages during the winter season due to severe weather, such as snow storms or freezing rain, have forced many residences and businesses to install additional emergency power equipment e.g. emergency generators and or batteries, in order to at least supply the power for essentials such as emergency lighting, heat (power to the furnace fan and controls), and for a refrigerator and freezer. These emergency power accommodations need to be permanently interconnected into the various components requiring power or interconnected when the power failure occurs and disconnected when power has been resumed. In either case, a substantial expense needs to be incurred in order to provide the necessary equipment which is seldom used.

A common arrangement of a comfort system for a residence or small business is the combination of an air conditioning and heating system with an evaporator coil, such as a so called A-coil, mounted in the top portion of a furnace such that the single blower can be used to alternatively circulate the air to be conditioned over a furnace heat exchanger or over the evaporator coil and then further distributed to the spaces to be heated or cooled. When a system is operating in the heating mode, the evaporator coil is disposed within the air flow path but is not active. Similarly, when operating in the cooling mode, the furnace heat exchanger lies within a path of the air being circulated by the fan, but the furnace heat exchanger is not heated.

SUMMARY OF THE INVENTION

Briefly, in accordance with one aspect of the invention, during periods in which the heating function is desired but the normal power accommodation is not available, the air conditioning system is activated with the compressor operating in reverse as an expander. In this way, the compressor/expander can operate in an organic rankine cycle to drive a generator to provide emergency power to the various components requiring power to operate.

By yet another aspect of the invention, provision is made to selectively change the flow of refrigerant from the low pressure side of the compressor/expander for use in a cooling mode, to the high pressure side thereof for use in an emergency power mode. Similarly, provision is made to interconnect the condenser to either the low or the high pressure side of the compressor/expander to facilitate the respective emergency power and cooling modes.

By yet another aspect of the invention, provision is made to selectively provide either an expansion valve or a pump to facilitate the flow of refrigerant from the condenser to the evaporator for the respective operations in the cooling or emergency power modes.

In the drawings as hereinafter described, a preferred embodiment is depicted; however, various other modifications and alternate constructions can be made thereto without departing from the true spirt and scope of the invention.

DESCRIPTION OF THE PREFERRED EMBODIMENT

Figure 1:
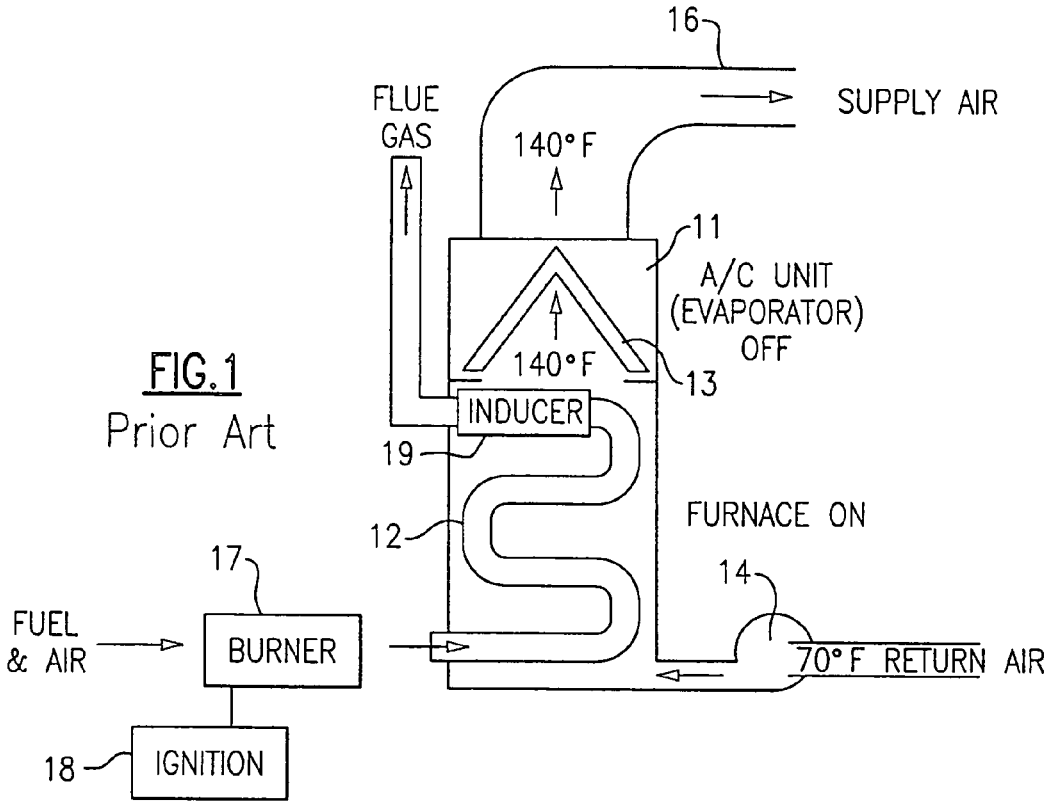
FIG.1 Prior Art
FIG. 1 is a schematic illustration of a combined hot air furnace and air conditioning system as operating in the heating mode in accordance with the prior art.
Figure 2:
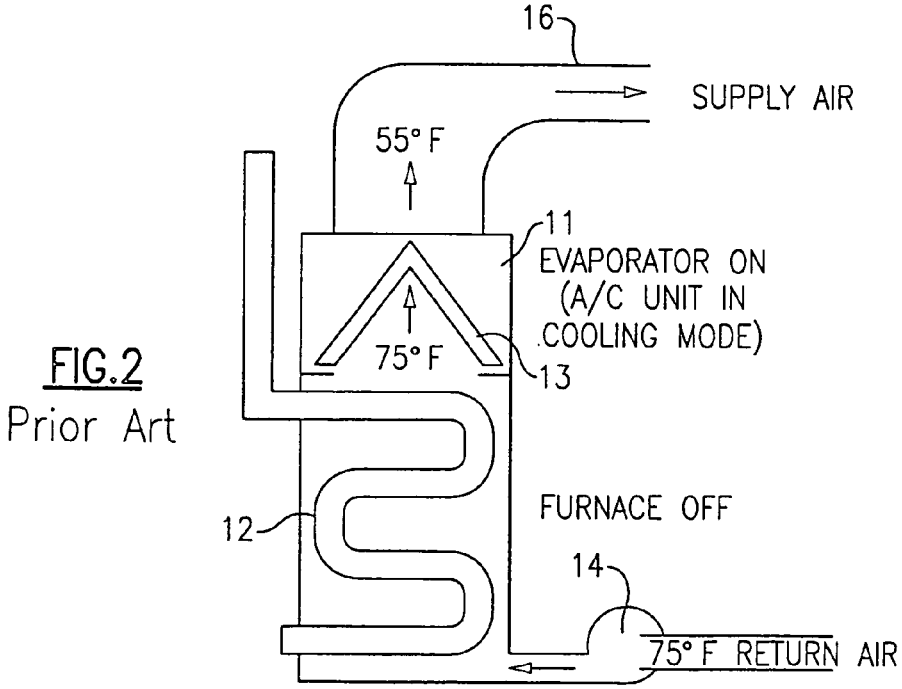
FIG.2 Prior Art
FIG. 2 is a schematic illustration of a combined hot air furnace and air conditioning system as operating in the cooling mode in accordance with the prior art.

Referring now to FIGS. 1 and 2, there is shown a typical comfort system of the type found in a residence or small business, comprising a furnace 11 having a heat exchanger 12 in the lower end thereof and an air conditioner evaporator coil 13 in the upper end thereof. A blower 14 is provided to bring air in from the space being conditioned, pass it through the furnace 11 and supply the heated or cooled air to a supply air duct 16 for distribution within the space to be conditioned.

As shown in FIG. 1, during heating operation, fuel and air are introduced to a burner 17 with the combination being ignited by an ignitor 18 so as to introduce hot combustion gases into the heat exchanger 12. The gases are drawn up through the heat exchanger 12 by an inducer 19, with the flue gas being then discharged to the atmosphere. The blower 14, in turn, circulates air over the heat exchanger 12 where it is heated to around 140° F. as it passes to the supply air duct 16. Although the evaporator coil 13 remains within the air flow stream, it has no effect on the conditioning of the air passing thereover.

Figure 4:
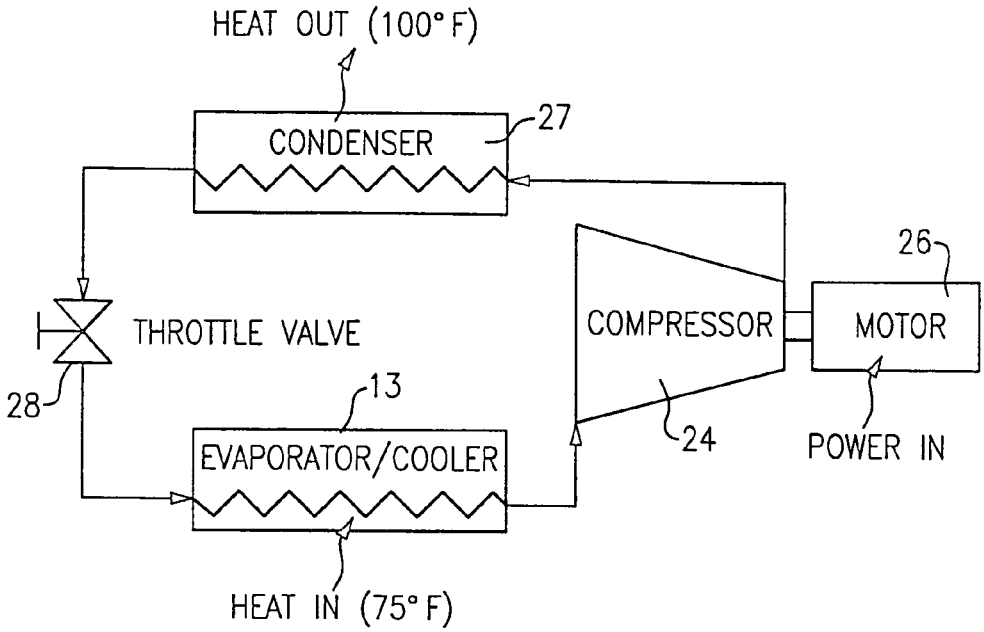
FIG. 4 is a schematic illustration of an air conditioning system operating in the cooling mode in accordance with the prior art.

During the cooling mode of operation, as shown in FIG. 2, the furnace is turned off and the heat exchanger 12, while remaining in the air flow stream from the blower 14, does not in any way contribute to the conditioning of the air passing through the furnace 11. The evaporator coil 13, which is operatively connected within an air conditioning circuit as shown in FIG. 4, has a relatively high pressure refrigerant such as R-22 or R-134a, being passed therethrough to provide a cooling effect to the air being circulated thereover. Thus, the 75° F. return air from the blower 14, when passed over the evaporator coil 13, is cooled to 55° F. prior to being passed to the supply air duct 16.

Figure 3A:
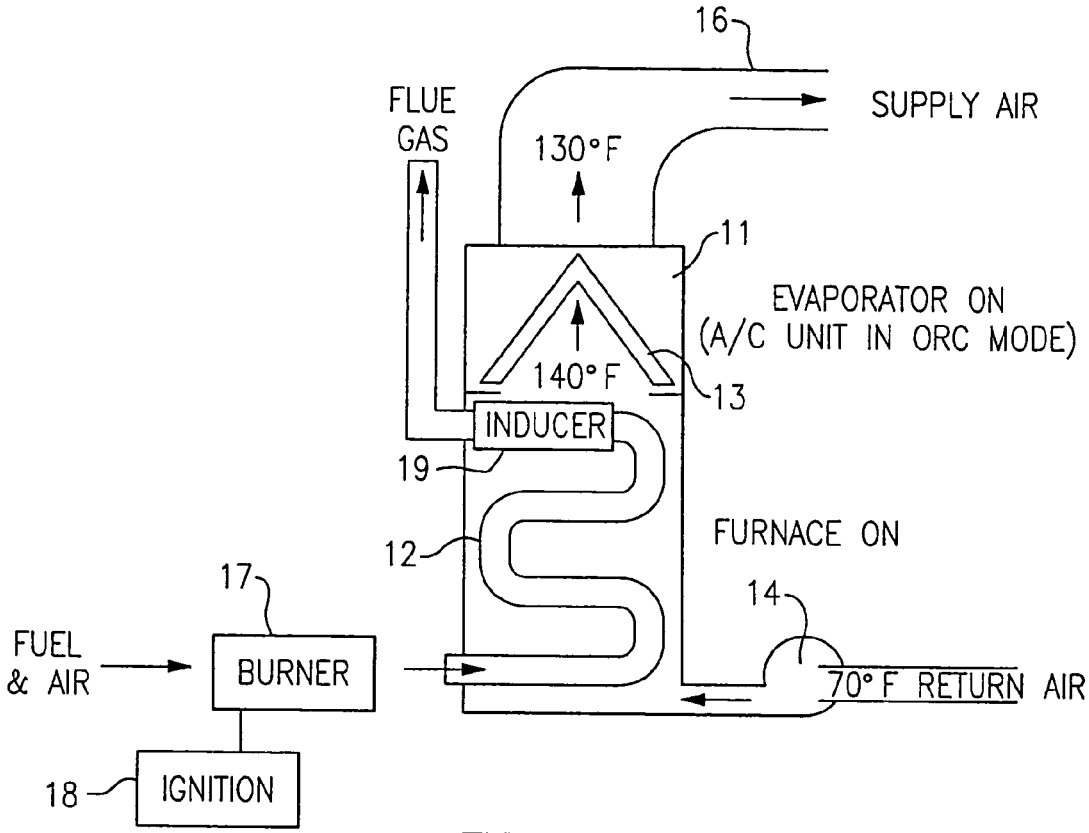
FIG. 3 is a schematic illustration of a combined hot air furnace and air conditioning system as operating in an emergency power mode in accordance with a preferred embodiment of the invention.
Figure 3B:
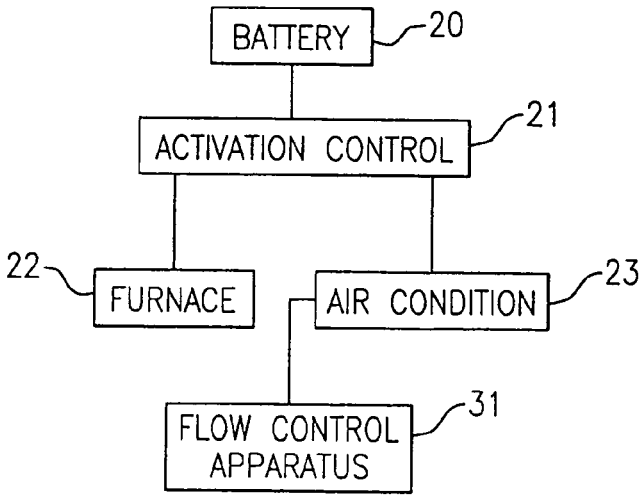

As shown in FIGS. 3*a* and 3*b* an activation control 21 which receive temporary emergency power from a battery 20, is provided to selectively activate the furnace 22 and/or the air conditioner 23 to provide heating or cooling or, by simultaneously activating the furnace 22 and the air conditioner 23, it can provide both heating and emergency power to operate the subsystems and other appliances.

When only operation of the furnace 22 is desired during low temperature ambient conditions, the activation control turns on the furnace 22 so as to function in the manner described with respect to FIG. 1.

When only the air conditioning mode of operation is desired during higher temperature ambient conditions, the activation control 21 turns on the air conditioner 23 so as to function in the manner described in respect to FIG. 2 hereof. In that case, the air conditioning circuit as shown in FIG. 4 includes, in addition to the evaporator 13 as described hereinabove, the compressor 24 driven by a motor 26, with the motor 26 being turned on or off by the activation control 21. The compressor receives refrigerant vapor from the evaporator 13 at its low pressure side and discharges higher pressure refrigerant from its high pressure side to a condenser 27. After the condenser causes the refrigerant to condense to a liquid, the liquid is passed to an expansion valve or throttle valve 28, and the throttle valve is selectively operated in order to control the flow of refrigerant into the evaporator 13.

Figure 5:
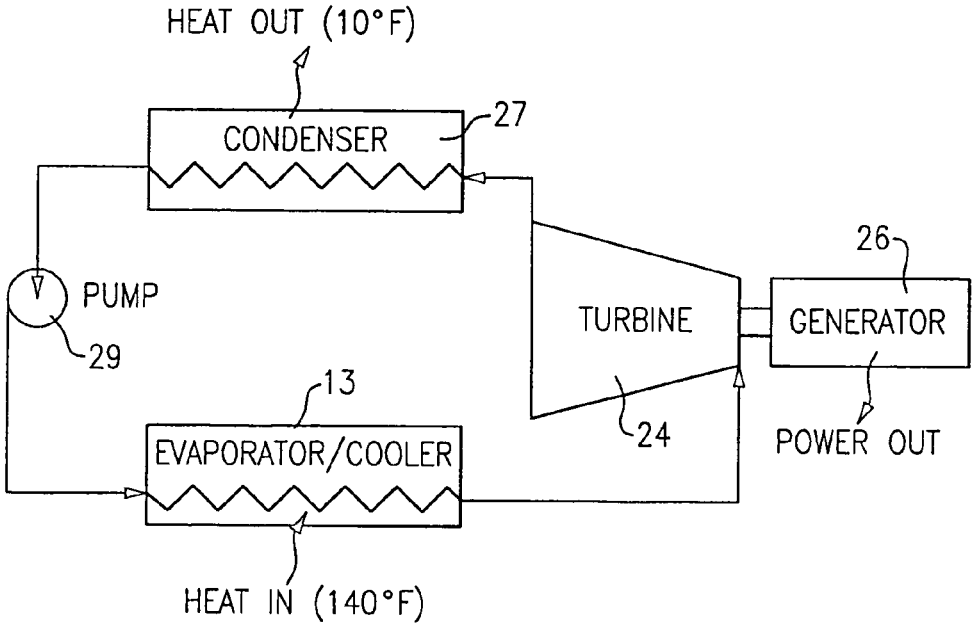
FIG. 5 is a schematic illustration of an air conditioning system as operating in an emergency power mode in accordance with a preferred embodiment of the invention.

During periods in which the normal power source is incapacitated, and when it is desired to operate the furnace 22 to supply at least some heat to the supply air duct 16, the hot air furnace/air conditioning system is operated as shown in FIG. 3*a*, with the activation control 21 turning on both the furnace 22 and the air conditioner 23. However, the air conditioner system 23 rather then operating as shown in its cooling mode as set forth in FIG. 4, is operated as an organic rankine cycle as shown in FIG. 5. Here, the evaporator 13 and condenser 27 operate in a similar manner as described hereinabove with respect to the cooling mode of operation. The compressor 24 and its drive motor 26, on the other hand operate substantially differently when in the emergency power mode of operation. Rather then the refrigerant passing into the low pressure side of the compressor and exiting from the high pressure side thereof as shown in FIG. 4, the refrigerant is passed to the high pressure side of the compressor (now acting as a turbine) and exits from the low pressure side thereof, with the lower pressure refrigerant then passing to the condenser 27. With the compressor/turbine acting as an expander, the motor 26 (which now operates as a generator) is driven by the expander to generate electricity for purposes of providing power to the blower 14, the ignitor 18, and the inducer 19, as well as to other appliances such as a refrigerator and/or freezer.

Suitable types of compressors that are commonly used in air conditioning systems and which can be effectively used in reverse as turbines include scroll compressors and screw compressors.

In order for the system to operate as shown in FIG. 5, it is necessary to add another component i.e. the pump 29 in order to pump condensate from the condenser 27 to the evaporator 13. The power generated by the generator 26 also provides power to the pump 29.

It should be recognized that, even though the compressor/turbine and the motor/generator operate in opposite directions for the respective cooling mode and emergency power mode, the flow of refrigerant is in the same direction for the two modes of operation. This is in contrast to a heat pump operation wherein a condenser and evaporator change roles with the transition from heating and cooling modes. In this regard, it should be recognized that the difference in ambient conditions causes the condenser during the cooling season to be at a higher pressure than the evaporator but at a lower pressure during winter organic rankine cycle mode of operation. That is, during a cooling mode of operation, a typical temperature of the air passing over the evaporator 13 is 75°, and the temperature of the air passing over the condenser is 100° F., whereas during winter ORC mode of operation, the heated air passing over the evaporator 13 is 140° F., and the temperature of the air passing over the outdoor condenser is 10° F.

As will be seen in FIG. 3*a*, during operation in the emergency power mode, with both the furnace 22 and the air conditioner 23 operating (but in the emergency power mode as shown in FIG. 5), the temperature of the air passing over the evaporator coil 13 is 140° F., but after using the energy of that heated air to drive the organic rankine cycle system as shown in FIG. 5 the temperature of the air is lowered to 130° F. However, this is still substantially above the temperature of the air in the space to be heated and will be sufficient to heat the space under emergency conditions.

Figure 6:
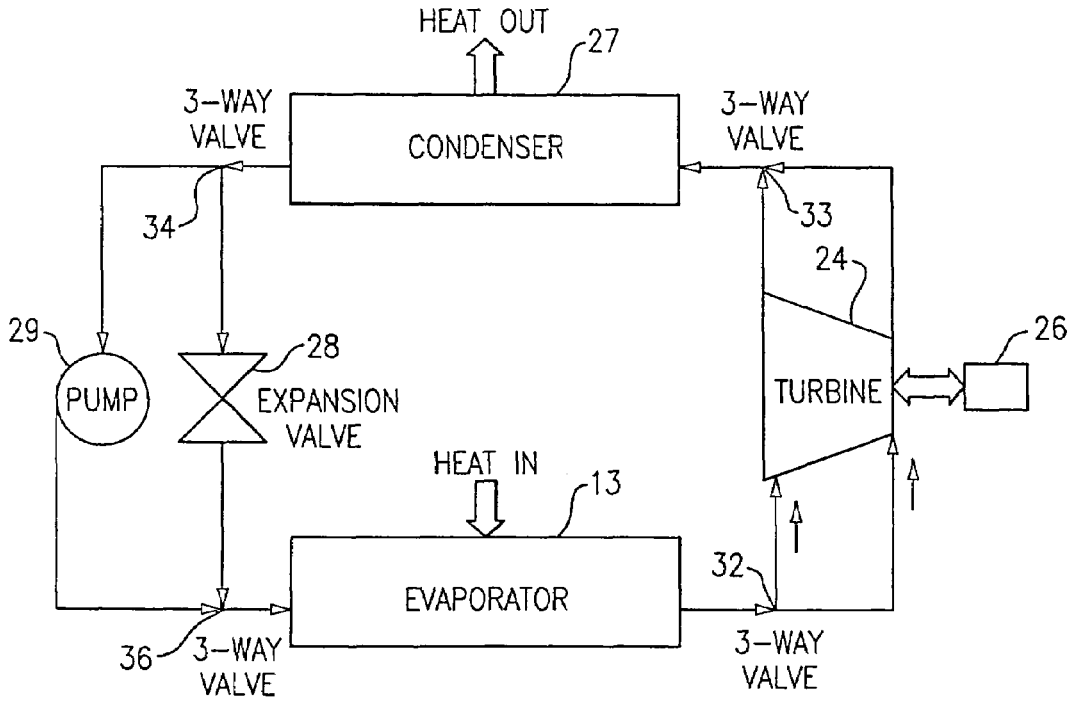
FIG. 6 is a schematic illustration of an air conditioning system as modified for emergency power capabilities in accordance with a preferred embodiment of the invention.

In order to convert the operation of the air conditioning unit 23 from that of the cooling mode as shown in FIG. 4 to the emergency power mode as shown in FIG. 5 it is necessary to activate the flow control apparatus 31 as shown in FIG. 3*b*. The flow control apparatus 31 simultaneously changes the flow into and out of the compressor/turbine as described hereinabove in respective FIG. 4 and FIG. 5, as well as bypassing the throttle valve 28 in favor of the pump 29. This can be accomplished by way of the insertion of the three way valves 32, 33, 34 and 36 as shown in FIG. 6. Thus, the three way valve 32 is selectively operated to cause the flow of refrigerant from the evaporator 13 to either the low pressure side of the compressor/turbine for purposes of cooling mode operation, or to the high pressure side thereof for emergency power mode operation. Similarly, the three way valve 33 is selectively operated to connect the low pressure side of the compressor/turbine 24 to the condenser 27 for emergency power mode operation or the high pressure side thereof to the condenser 27 for cooling mode operation.

In a similar manner, the three way valves 34 and 36 are operated to selectively direct the refrigerant flow through the expansion valve 28 during cooling mode operation or through the pump 29 during emergency power mode operation. Depending on the mode of operation, the compressor/turbine will either be driven by the motor/generator or will drive the motor/generator to produce power as described hereinabove.

Figure 7:
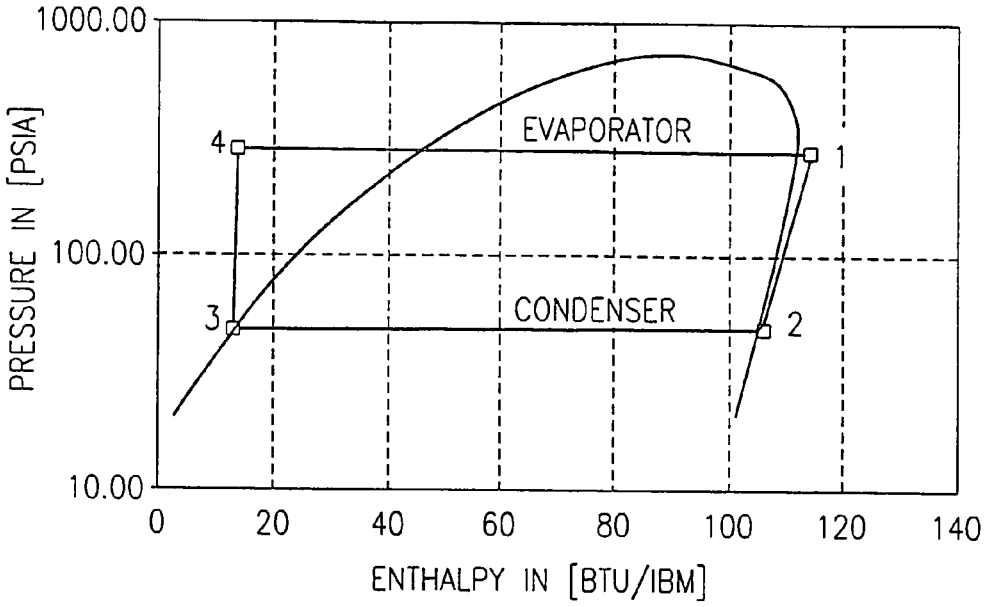
FIG. 7 is a PH diagram of a recuperated organic rankine cycle in accordance with a preferred embodiment of the invention.
Figure 8:
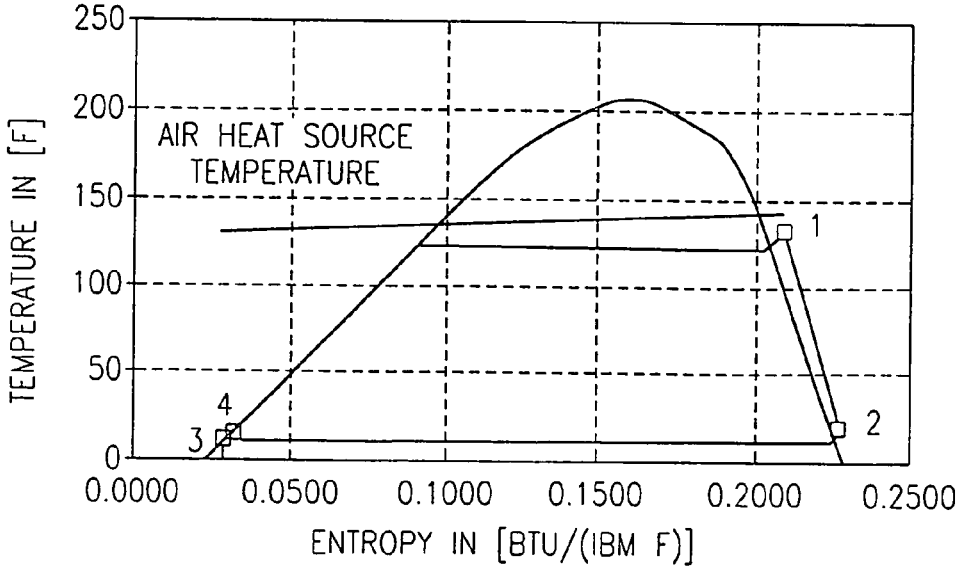
FIG. 8 is a TS diagram of a recuperated organic rankine cycle in accordance with a preferred embodiment of the invention.

Referring now to FIGS. 7 and 8 there is shown the thermodynamic calculations of the disclosed emergency power generation system during a typical winter day. FIG. 7 shows a pressure-enthalpy diagram of the system, indicating condenser and evaporator pressures when using an air conditioner with R-22 as refrigerant as a function of enthalpy. FIG. 8 shows the corresponding temperature-entropy diagram indicating condenser and evaporator saturation temperatures as a function of entropy. The process shown in FIGS. 7 and 8 follows a clockwise cycle (opposite from the counterclockwise air conditioning cycle). Starting at state point 1, the inlet of the expander, high-pressure hot refrigerant vapor expands from high pressure to low pressure when giving off its energy to the expander. After reaching the expander outlet (state point 2) the low pressure/low temperature refrigerant is de-superheated and liquefied in the condenser. State point 3 is the condenser exit where the liquified refrigerant has a low temperature and low pressure. A pump will not increase the pressure of the refrigerant without any measurable increase in temperature. The pump exit is state point 4. The thermodynamic cycle is completed after the high pressure liquid is vaporized in the evaporator from where the high pressure high temperature vapor will enter state point 1 again.

Assuming realistic pump and expander efficiencies and traditional HVAC heat exchanger heat transfer rates and pressure line losses, there calculations show that a 3.5 ton residential air conditioning unit when operating in reverse as an emergency power generation system can generate a net power of 75 Watts. This power is sufficient for the auxiliary equipment of the furnace (fans/pumps/controls) as well as residential refrigeration equipment and some emergency lighting, thereby proving the technical viability of the disclosed invention.

While the present invention has been particularly shown and described with reference to preferred and alternate embodiments as illustrated in the drawings, it will be understood by one skilled in the art that various changes in detail may be effected therein without departing from the spirit and scope of the invention as defined by the claims.

I claim:

1. A comfort system for heating or cooling air by the selective circulation of air over a furnace heat exchanger or over an air conditioning evaporator coil comprising:

a heating system for circulating hot gases through the heat exchanger;

an air conditioning system for circulating refrigerant through an evaporator coil, a compressor, a condenser and an expansion valve;

an activation control for simultaneously operating said heating and air conditioning systems to cause a combined heating of the air circulated thereover; and flow control apparatus for causing the flow of refrigerant to pass from said evaporator to a high pressure side of said compressor such that said compressor is driven in reverse to function as a turbine.

2. A comfort system as set forth in claim 1 wherein said compressor is a motor driven compressor and further wherein when said compressor is made to operate in reverse, said compressor functions to drive said motor in reverse to generate power.

3. A comfort system as set forth in claim 1 wherein said compressor is a scroll compressor.

4. A comfort system as set forth in claim 1 wherein said compressor is a screw compressor.

5. A comfort system as set forth in claim 1 and including a pump for circulating refrigerant from said condenser to said evaporator.

6. A comfort system as set forth in claim 1 wherein said flow control apparatus includes valve means for conducting the flow of refrigerant from a low pressure side of said compressor to said condenser.

7. A comfort system as set forth in claim 1 wherein flow control apparatus includes valve means for conducting the flow of refrigerant from said condenser to a pump.

8. A comfort system as set forth in claim 1 wherein said flow control apparatus includes valve means for conducting the flow of refrigerant of a pump to said evaporator.

9. A comfort system as set forth in claim 1 wherein said flow control apparatus includes at least one three way valve.

10. A comfort system as set forth in claim 1 wherein said activation control also includes a battery.

11. A method operating a comfort system having a heating system and a cooling system, the heating system having a heat exchanger through which hot gases are circulated and over which air is circulated to be heated, and the cooling system having in serial flow relationship a motor driven compressor, a condenser, an expansion valve and an evaporator coil, said heat exchanger and said evaporator coil both being in the path of the circulated air, comprising the steps of:

causing said comfort system to operate such that circulated air passes over both said heat exchanger to be heated and over said evaporator coil; and changing the flow of refrigerant into said compressor from a low pressure side thereof to a high pressure side thereof so as to cause it to operate in reverse as a turbine.

12. A method as set forth in claim 11 and including the step of providing a pump to circulate refrigerant from said condenser to said evaporator coil.

13. A method as set forth in claim 11 wherein said compressor is motor driven and further wherein the step of causing said compressor to operate in reverse also causes said compressor to drive said motor in reverse such that said motor functions as a generator.

14. A method as set forth in claim 11 wherein said compressor is a scroll compressor.

15. A method as set forth in claim 11 wherein said compressor is a screw compressor.

* * * * *